United States Patent [19]

Barakitis et al.

[11] 4,412,152

[45] Oct. 25, 1983

[54] DISCHARGE LAMP WITH BIMETAL STARTER

[75] Inventors: Nikolaos Barakitis, Haverhill; Sheppard Cohen, Danvers, both of Mass.

[73] Assignee: GTE Products Corporation, Stamford, Conn.

[21] Appl. No.: 398,723

[22] Filed: Jul. 19, 1982

[51] Int. Cl.[3] ..... H05B 41/06

[52] U.S. Cl. ..... 315/73; 315/47; 315/290

[58] Field of Search ..... 315/47, 56, 73, 289, 315/290, DIG. 5; 337/22, 27

[56] References Cited

U.S. PATENT DOCUMENTS

| | | | |
|---|---|---|---|
| 3,965,387 | 6/1976 | Stuart | 315/47 |
| 4,001,634 | 1/1977 | Corbley et al. | 315/73 |
| 4,355,265 | 10/1982 | Cohen et al. | 315/290 |

*Primary Examiner*—Eugene R. LaRoche
*Attorney, Agent, or Firm*—Thomas H. Buffton

[57] ABSTRACT

A high intensity discharge lamp having a hermetically sealed envelope with support wires therethrough has an arc tube therein with support wires whereby a starter device having first and second contacts of a normally-closed switch has a first bimetal coupling the first contact to one support wire and a second bimetal coupling a second contact to another support wire with the bimetals positioned to flex in opposite directions and enhance the operation of the contacts and of the high intensity discharge lamp.

12 Claims; 3 Drawing Figures

DISCHARGE LAMP WITH BIMETAL STARTER

TECHNICAL FIELD

This invention relates to high intensity discharge lamps and more particularly to high intensity discharge lamps utilizing a starter device employing multiple bimetals to control a switching capability.

BACKGROUND ART

Generally, high pressure high intensity discharge lamps include an arc tube disposed within a bulbous envelope. A gaseous electric relay device or glow starter device having a heat-responsive element adapted to emit electrons is shunted across the lamp. For example, U.S. Pat. No. 2,200,443, issued to Edward C. Dench, sets forth an appropriate glow starter device. Such a device develops a glow arc which heats a heat-responsive element and, in turn, causes a ballast to develop a potential across the discharge lamp whereupon conductivity of the lamp is effected. Thereupon, the glow starter device is rendered inoperative so long as lamp conductivity is maintained. However, it has been found that problems do exist in effecting proper operative of the glow starter device and lamp.

One attempt to rectify the above-described undesirable discharge lamp conditions is set forth in a copending U.S. application entitled, "Discharge Lamp With Integral Starter," filed Dec. 15, 1980, bearing U.S. Ser. No. 216,875 and assigned to the assignee of the present invention. Therein a gas-filled discharge lamp includes a glow starter device having a bimetal affixed to one contact and a rigid rod affixed to another contact. Short circuit current flows through the bimetal and rigid rod in an amount sufficient to activate the bimetal and separate the contacts. Thereupon, a pulse potential from a ballast sourse is applied to and normally effects conductivity of a discharge lamp. Should the lamp fail to ignite, the bimetal cools and returns to provide engagement of the contacts and a repetition of the cycle.

Another configuration for enhancing the previously-described relay system is described in a copending U.S. patent application, bearing U.S. Ser. No. 376,804, filed May 10, 1982, in the names of the present Applicants and assigned to the Assignee of the present application. Therein an arc tube is disposed within an evacuated envelope, a bimetal starter device having a bimetal and a rigid conductor each affixed to a switch contact are connected to leads passing through the evacuated envelope, and a spark gap is shunted across the arc tube. Upon occurrence of undesired excessive transient voltages, the spark gap serves to protect the discharge lamp and associated apparatus.

Although the above-described apparatus has numerous advantages over prior known structures, it has been found that there are some applications wherein a problem still exists. For example, it has been found that there are applications wherein the starter device has a tendency to stick or, in other words, the contacts of the starter device fail to open. Also, it has been found that lamps utilizing a starter device with a rigid contact member support tend to have a less than satisfactory life span. Moreover, lamps employing a starter with a rigid contact member appear to be more susceptible to shock which is obviously undesirable.

OBJECTS AND SUMMARY OF THE INVENTION

An object of the present invention is to provide an improved high intensity discharge lamp. Another object of the invention is to provide an enhanced discharge lamp having improved starting and operating capabilities. Still another object of the invention is to simplify and reduce cost of an enhanced discharge lamp. A still further object of the invention is to provide an enhanced discharge lamp having a starter device utilizing multiple bimetals formed to flex in opposite directions.

These and other objects, advantages and capabilities are achieved in one aspect of the invention by a high intensity discharge lamp wherein an arc tube is sealed within an envelope having a pair of support wires with one support wire affixed to a lead of the arc tube and to bimetal connected to one contact of a switch. The other contact of the switch is connected by another bimetal to the other support wire of the envelope and by a conductor to the arc tube.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
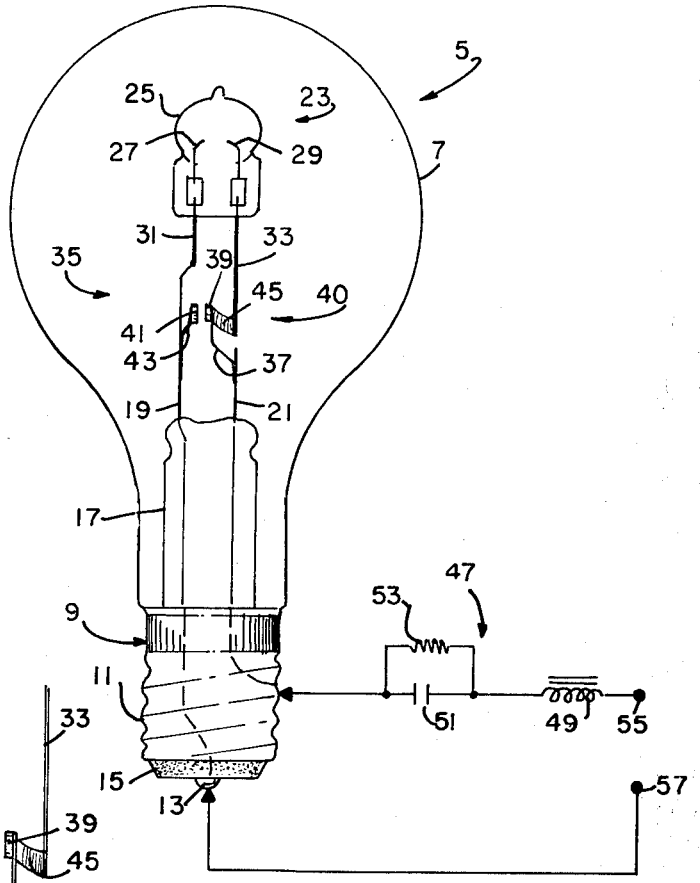
FIG. 1 is an elevational cross-section of a preferred embodiment of a discharge lamp of the invention.
Figure 2:
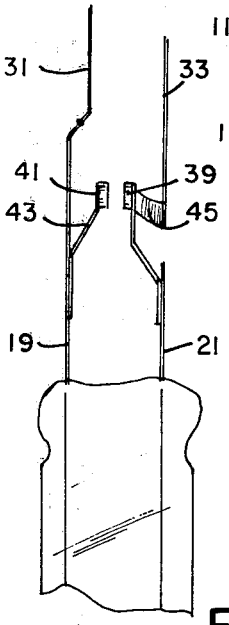
FIG. 2 is an enlarged fragmentary view of a portion of FIG. 1.

Referring to FIGS. 1 and 2 of the drawings, a preferred form of discharge lamp apparatus includes a discharge lamp 5 having an outer bulbous envelope 7 with an affixed conventional screw-in base 9. The screw-in base 9 has a metal shell 11 and a central electrical contact 13 separated from the shell 11 by an electrical insulating material 15. A glass stem mount 17 is hermetically sealed to the bulbous envelope 7, and a first support wire 19 is connected to the central electrical contact 13 and extends into the envelope 7. A second support wire 21 is connected to the metal shell 11 and also extends into the envelope 7.

Disposed within the bulbous envelope 7 is an arc tube 23. The arc tube 23 has a second envelope 25 with a pair of electrodes 27 and 29 therein. Each of the electrodes 27 and 29 is connected to one of a pair of electrical leads, 31 and 33 respectively, extending outwardly of the second envelope 25. The first lead 31 is directly connected to the first electrical support wire 19 of the outer envelope 7.

Also disposed within the outer bulbous envelope 7 is a starter device 35. The starter device 35 has a first bimetal 37 connecting a first contact 39 to the second support wire 21 of the envelope 7. A second contact 41 of the glow starter device 35 is connected to the first support wire 19 of the envelope 7 by a second bimetal 43. A third bimetal 45 connects the first contact 39 to the electrical lead 33 of the arc tube 23. Thus, the first and second contacts 39 and 41 form a normally-closed (N/C) switch 40 within the outer envelope 7.

Additionally, starting and operating circuitry for the discharge lamp 5 is coupled thereto. More specifically, a ballast means 47 including a series-connected inductor 49 and capacitor 51 with a resistor 53 shunting the capacitor 51 is coupled to the second support wire 21 of the lamp 5 by way of the metal shell 11. The ballast means 47 is also coupled to a first terminal 55 suitable for attachment to an AC potential source. The second terminal 57 formed for attachment to the AC potential source is coupled by way of the central electrical contact 13 to the first support wire 19 of the lamp 5. Thus, the first contact 39 of a N/C switch is, in effect, coupled by the first bimetal 37 to the ballast means 47 and by the third bimetal 45 to the arc tube 23. The second contact 41 is coupled by the second bimetal 43 to the arc lamp 23 and the second terminal 57 formed for attachment to the AC potential source.

In operation, a short circuit current flows from the AC source through the ballast means 47, the first bimetal 37, the switch contacts 39 and 41, and the second bimetal 43 back to the AC source. The first and second bimetals 37 and 43 are formed to flex in diametrically opposite directions and are responsive to the heat developed therein by the $I^2R$ energy. Thus, the first and second bimetals 37 and 43 flex in opposite directions separating the first and second contacts 39 and 41 of the normally-closed switch 40. Thereupon, a pulse potential from the ballast means 47 is applied to and initiates conductivity in the arc lamp 23. Moreover, current flow through the first and third bimetals 37 and 45 serves to maintain the normally-closed switch 40 in an open position.

Additionally, the above-described embodiment may include a gas fill within the outer envelope 7 in order to facilitate operation of the glow starter device 35 and control of the pulse potentials developed for initiating conductivity of the arc tube 23. Such a gas fill within the envelope 7 also serves to maintain a non-corrosive atmosphere surrounding the normally-closed switch 40 of the glow starter device 35 and the electrical leads 31 and 33 of the arc tube 23.

Figure 3:
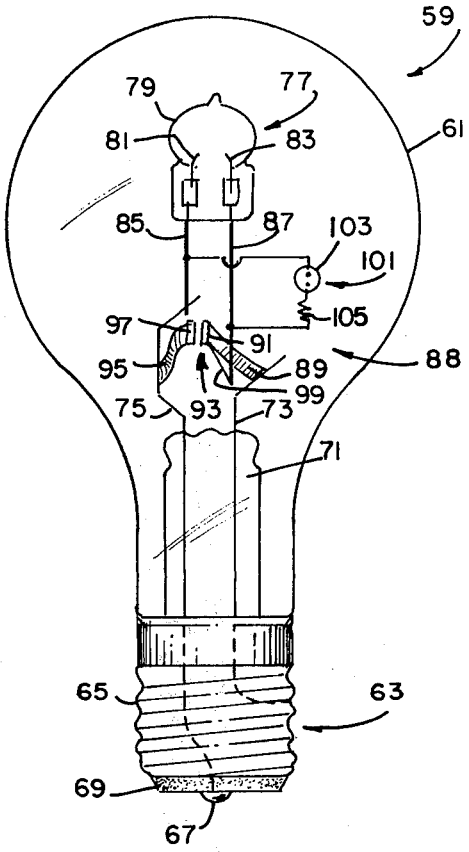
FIG. 3 is an alternative elevational view of a discharge lamp of the invention.

An alternative arrangement and structure is illustrated in the embodiment of FIG. 3. Therein, a discharge lamp 59 has an outer hermetically sealed and evacuated envelope 61. A screw-in base 63 is affixed thereto with a metal shell 65 having a central conductor 67 separated therefrom by an insulator 69. A glass stem 71 is hermetically sealed to the envelope 61 with a first support wire 73 contacting the metal shell 65 and passing through the envelope 61. A second support wire 75 is connected to the central conductor 67 and passes through the envelope 61.

Within the evacuated envelope 61, an arc tube 77 includes a second hermetically sealed envelope 79 wherein is disposed first and second electrodes 81 and 83 respectively. A first electrical lead 85 is connected to the first electrode 81 and extends outwardly of the envelope 79. A second electrical lead 87 is connected to the second electrode 83 and also extends outwardly of the envelope 79.

A starter device 88 is located within the evacuated envelope 61 and includes a first bimetal 89 coupling a first contact 91 of a normally-closed (N/C) switch 93 to the first support wire 73, a second bimetal 95 coupling a second contact 97 to the second support wire 75 and an electrical conductor 99 coupling the first contact 91 to the second electrical lead 87 of the arc tube 77. Also, a spark gap means 101 including a series connecting spark gap 103 and current limiting resistor 105 is coupled to the first and second electrical leads 85 and 87 of the arc tube 77.

Operation of the above-described embodiment is similar to the operation of the embodiment of FIG. 1 in that short circuit current flows through the first and second bimetals 89 and 95 which are positioned to flex in opposite directions and thereby exert a combined force separating the first and second contacts 91 and 97 of the normally-closed (N/C) switch 93. However, it has been found that the circuitry is susceptible to excessive switching transient voltages when conductivity of the arc tube 77 is not effected. Thus, the spark gap 103 and current limiting resistor 105 insure an arc over voltage which is greater than the breakdown voltage of the arc tube 77 but less than the voltage value which would damage associated components and circuitry.

Thus, there has been provided a discharge lamp suitable for inclusion therein of a unique starter device. The glow starter device includes at least two bimetals which are positioned to flex in opposite directions and thereby enhance the separating capabilities of the contacts of the glow starter device and the operation of the discharge lamps. Alternate embodiments such as gas filled and evacuated envelopes are appropriate to the apparatus. Moreover, the provision of a separate envelope surrounding the glow starter device is also appropriate to the apparatus.

While there has been shown and described what is at present considered the preferred embodiments of the invention, it will be obvious to those skilled in the art that various changes and modifications may be made therein without departing from the invention as defined by the appended claims.

What is claimed is:

1. A high intensity discharge lamp comprising:

a first heremetically sealed envelope having first and second electrically conductive support wires sealed therein and passing therethrough;

a hermetically sealed arc tube disposed within said first envelope and having first and second electrical leads sealed therein and passing therethrough with said first electrical lead connected to said first support wire; and a starter device disposed within said first envelope and including a normally-closed switch having first and second contacts, a first bimetal coupling said first contact to said second support wire, an electrical connector coupling said first contact to said second electrical lead, and a second bimetal coupling said second contact to said first support wire.

2. The discharge lamp of claim 1 wherein said first hermetically sealed envelope has a gas fill therein.

3. The discharge lamp of claim 1 wherein said first hermetically sealed envelope is an evacuated envelope.

4. The discharge lamp of claim 1 wherein said electrical connector of said glow starter device is in the form of a third bimetal.

5. The discharge lamp of claim 3 wherein said first hermetically sealed evacuated envelope includes a spark gap means coupled to said first and second electrical leads.

6. The discharge lamp of claim 3 wherein said first hermetically sealed evacuated envelope includes a series-connected spark gap and current limiting resistor coupled to said first and second lead of said arc tube.

7. The discharge lamp of claim 1 wherein said starter device includes a gas filled envelope and is disposed within said first hermetically sealed envelope.

8. The discharge lamp of claim 1 wherein said starter device includes a second hermetically sealed envelope and is located external to said first hermetically sealed envelope.

9. A high intensity discharge lamp comprising:

a first evacuated envelope having first and second electrically conductive support wires sealed therein and passing therethrough;

an arc tube within said first envelope and having first and second electrical leads sealed therein with said first electrical lead connected to said first support wire of said first evacuated envelope;

a starter device having a switch with first and second contacts, a first bimetal coupling said first contact to said second support wire, an electrical conductor coupling said first contact to said second electrical lead and a second bimetal coupling said second contact to said first support wire; and spark gap means coupled to said first and second support wires whereby said first and second bimetals have oppositely directed flexure capabilities for separating said first and second contacts.

10. The discharge lamp of claim 9 wherein said electrical conductor of said glow starter device is in the form of a third bimetal having the same direction of flexure as said first bimetal.

11. The discharge lamp of claim 9 wherein said spark gap means includes a series-connected spark gap and current limiting resistor.

12. The discharge lamp of claim 9 wherein said spark gap means includes a spark gap having a breakdown voltage greater than the breakdown voltage of said discharge lamp.

* * * * *